US005393477A

United States Patent [19]

Ittel et al.

[11] Patent Number: 5,393,477

[45] Date of Patent: Feb. 28, 1995

[54] AIR GAP SPINNING PROCESS FOR ARAMIDS

[75] Inventors: Steven D. Ittel; Hsiang Shih, both of Wilmington, Del.

[73] Assignee: E. I. Du Pont de Nemours and Company, Wilmington, Del.

[21] Appl. No.: 131,255

[22] Filed: Oct. 1, 1993

[51] Int. Cl.[6] ..... D01D 5/06; D01F 6/60

[52] U.S. Cl. ..... 264/184; 264/203; 264/211.16

[58] Field of Search ..... 264/184, 203, 211.14, 264/211.16, 561, 562

[56] References Cited

U.S. PATENT DOCUMENTS 3,742,104 6/1973 Jamison et al. ..... 264/184 X
3,767,756 10/1973 Blades ..... 264/184
3,869,429 3/1975 Blades ..... 528/341
4,529,763 7/1985 Tamura et al. ..... 524/230

OTHER PUBLICATIONS

Mark, H. F. et al. *Encyclopedia of Polymer Science and Engineering,* John Wiley & Sons (New York), vol. 6, pp. 246 and 248 (1986).

Hoyt, J. W. "Drag Reduction". *Encyclopedia of Polymer Science and Engineering,* vol. 5, 3rd Ed. (1986), pp. 129–151.

Abstract of Japan 51–118,323 (Published Sep. 29, 1976).

*Primary Examiner*—Leo B. Tentoni

[57] ABSTRACT

An improved process for spinning aramids from solution using the air gap wet spinning method involves using a coagulant that contains 1 to 1000 ppm by weight of an organic polymer that acts as a drag reducer. Improved productivity and/or finer aramid fibers is obtained with no deterioration of fiber physical properties.

16 Claims, No Drawings

AIR GAP SPINNING PROCESS FOR ARAMIDS

FIELD OF THE INVENTION

Disclosed herein is an improved air gap aramid fiber spinning process in which a polymeric drag reducing agent is added to an aqueous coagulant. This allows more fiber or fiber with a smaller diameter to be produced on the same apparatus.

TECHNICAL BACKGROUND

One method of wet spinning fibers is called air gap spinning (or alternately "dry-jet wet spinning"), and it is particularly useful for spinning aramid fibers from solutions of aramids. Such processes are well known in the art, see for instance U.S. Pat. Nos. 3,767,756 and 3,869,429, and B. Huang, et al., Zhongquo Fangzhi Daxue Xuebao, vol. 16, p. 23–30 (1990), all of which are hereby included by reference.

In air gap spinning, a solution of a polymer such as an aramid is forced through a spinneret. The face of the spinneret is in contact only with a gas, usually air. After travelling a short distance through the air, typically 0.1–10 cm., the solution (in the form of a fine "jet") enters a coagulant, which extracts the solvent from the polymer, resulting in the formation of a polymer fiber. Often this coagulant is water based, although anything that is miscible with the material that the polymer is dissolved in, and in which the polymer is insoluble and preferably does not swell appreciably, may be used. Importantly, in the gap between the spinneret face and the coagulant, the fiber solution, which is usually quite viscous and somewhat viscoelastic, is drawn, resulting in a smaller diameter jet of aramid solution entering the coagulant than was extruded from the spinneret holes.

The amount of drawing that can be done is limited, because above some maximum draw value fiber physical properties such as tensile strength, start to decrease. In the invention described herein, use of a drag reducer in the coagulant bath allows higher draw ratios to be achieved in the spinning process without deleterious effects on fiber physical properties.

U.S. Pat. No. 4,529,763 discloses that coagulant baths may contain relatively high amounts, preferably 30% or more, polyalkylene oxides, and no mention is made of using very high molecular weight polyalkylene oxides.

Japanese Patent 76-118323 describes a spinning process in which the coagulating bath is a pure polyalkylene glycol, preferably polyethylene glycol.

SUMMARY OF THE INVENTION

This invention concerns a process for the air gap spinning of an aramid fiber from an aramid solution, wherein a solution of an aramid polymer is forced through an orifice, then travels through a layer of gas into a coagulant to form an aramid fiber wherein the improvement comprises, an aqueous coagulant which contains from 1 ppm to about 1,000 ppm by weight of an organic polymer which acts as a drag reducer, and provided said organic polymer is soluble in said coagulant and has a molecular of 200,000 or more.

DETAILS OF THE INVENTION

This process is particularly useful for spinning aramid fibers. Preferred aramids are poly(p-phenylene terephthalamide), poly(p-phenylene p,p'-biphenyldicarboxamide, and poly(p-phenylene 1,5-naphthalenedicarobxamide) which can all form lyotropic solutions, and poly(m-phenylene isophthalamide), which forms isotropic solutions. Particularly preferred aramids are those that form lyotropic solutions, and an especially preferred aramid is poly(p-phenylene terephthalamide). A preferred aramid solution is poly(p-phenylene terephthalamide) dissolved in sulfuric acid.

By an aqueous coagulant herein is meant a liquid which contains at least 50% by weight water, before being used as a coagulant. During use the coagulant mixes with (dissolves) the solvent(s) in which the aramid is dissolved, so the composition of the coagulant changes during use. It is preferred if the unused coagulant contains at least 85% by weight of water, more preferred if it contains at least 95% by weight of water, and especially preferred if it contains at least 99% by weight of water.

The coagulant described herein also contains a drag reducing polymer. By a drag reducing polymer is meant a polymer which reduces the frictional force between the polymer solution and an object moving with respect to that solution, such as the solution flowing through a pipe, or a fiber being pulled through the solution. Such polymers, their properties, and tests for drag reduction, are known in the art, see for instance J. W. Hoyt in H. Mark, et al. Ed., Encyclopedia of Polymer Science and Engineering, vol. 5, 3rd Ed., p. 129–151 (1986), which is hereby included by reference. As explained in this reference, the higher the molecular weight of the polymer, the more effective the polymer is as a drag reducer. Therefore, it is preferred if the (number average) molecular weight of the polymer is at least 200,000, more preferably at least 500,000, and especially preferably at least 1,000,000.

Useful drag reducing polymers include, but are not limited to poly (ethylene oxide), poly (acrylamide), xanthans and guar gum. Poly(ethylene oxide) and poly(acrylamide) are preferred polymers, and poly(ethylene oxide) is especially preferred. The drag reducing polymers are usually soluble in water, and should be soluble in the coagulant actually used. The concentration of the drag reducing polymer is about 1 ppm (part per million) to about 1,000 ppm by weight, preferably about 5 ppm to about 500 ppm, and more preferably about 8 ppm to about 200 ppm. The optimum concentration will depend on many factors such as the drag reducing polymer being used, the aramid being spun and spinneret size. Generally speaking, the higher the molecular weight of the drag reducing polymer, the lower the concentration that will be needed in the coagulant.

Some drag reducing polymers, particularly natural polymers, may have some fraction that is insoluble in water. This insoluble fraction should preferably be removed, as by filtration of the solution. The coagulant may contain any other ingredients normally found in coagulants as long as the drag reducing polymer is soluble in the coagulant. The temperature of the coagulant bath is not critical, and a temperature range of about −40° C. to about 80° C., preferably −20° C. to 60° C. is convenient (the freezing temperature of the coagulant can be lowered, if desired, by addition of compounds such as ethylene glycol).

By the draw ratio, or spin-stretch factor (SSF), herein is meant the linear windup rate of the coagulated fiber divided by the linear rate of flow (JV, jet velocity) of the aramid solution through a spinneret hole. It has been found in many cases (see Examples 1 and 2) that if the SSF exceeds a certain value the tensile strength (also called tenacity) of the fiber starts decreasing. Thus for uses where tenacity is important, there is an upper limitation on the SSF, which for any given fiber diameter, means an upper limitation on the amount of fiber that can be spun through a particular spinneret, and/or a lower limitation on the diameter of the fiber with any particular spinneret.

Use of the drag reducing polymer allows the polymer solution exiting the spinneret to be more highly drawn (higher SSF), resulting in a capacity increase for the spinning apparatus if a spinneret with larger holes is used, or allowing finer (lower diameter) fibers to be made at the same spin rates using the original spinneret. By capacity is meant the weight of aramid fiber produced per unit time. Finer aramid fibers are particularly useful in garments, such a bullet proof garment or fire fighter's coats, where they are more comfortable because they more readily conform to body shape and movement.

In the Examples, the following abbreviations are used:

dpf - denier per filament gpd - grams per denier

JV - jet velocity (linear velocity of polymer exiting a spinneret hole

MW - (number average) molecular weight

PEO - poly (ethylene oxide)

PPD-T - poly (p-phenylene terephthalamide)

SSF - spin-stretch factor

EXAMPLE 1

A 0.1% (by weight) solution of poly(ethylene oxide) (Polyox® 301 from Union Carbide, reported to be 4,000,000 molecular weight) was prepared in distilled water. The polymer was added to the water with rapid stirring to make a well dispersed suspension. The suspension was then placed on a roller mill and rolled until everything went into solution. A PPD-T dope of 19.4% solids was prepared as follows: a double helix mixer (made by Atlantic) was prechilled with a dry ice/acetone bath, then 145.4 grams of 100.05% fuming sulfuric acid was poured in and the mixer turned on to slow speed while maintaining a nitrogen purge. The acid was chilled to −5° C. with an external dry ice bath, and 35.0 grams of PPD-T was added to the mixer. The polymer was mixed for twenty minutes before the dry ice was removed. The mixer was first dipped in warm water to bring its temperature to room temperature and later heated to 72° C. The dope was mixed under these conditions for 1.5 hours and the mixer was then heated to 80° C. After reaching that temperature, vacuum was applied and the dope was mixed for an additional hour. The dope was charged into a preheated spinning cell through an opening in the mixer base plate. The cell temperature was maintained at −80° C.

All fiber was spun into a stagnant water bath at 0°-5° C. with a 0.5 cm air gap. Two quench bath coagulants were prepared by diluting PEO of four million molecular weight in water to 10 and 100 parts per million concentrations, respectively. A spinning experiment with a pure water coagulant bath was also conducted as a control. A 3-hole spin pack was used consisting of spinnerets of 0.076 mm diameter and 3.0 L/D. JV was controlled at 20 m/min. The experiment was carried out by collecting fiber samples, with different quench baths, at increasing spin stretch factors (SSF). Maximum obtainable SSF was determined and tensile properties of samples collected at different SSF's were assessed. Results are summarized in Table 1.

TABLE 1

| Sample # | JV | SSF | Tenacity (gpd) | Elongation (%) | Modulus (gpd) | dpf |
|---|---|---|---|---|---|---|
| WATER COAGULANT CONTAINING 10 PPM POLYETHYLENE OXIDE | | | | | | |
| 1 | 20.5 | 3.4 | 22.5 | 6.23 | 346 | 4.5 |
| 2 | 20.9 | 6.9 | 25.5 | 6.65 | 327 | 2.3 |
| 3 | 20.7 | 9.2 | 23.0 | 5.93 | 319 | 1.6 |
| 4 | 20.1 | 14.0 | 25.8 | 5.91 | 343 | 1.3 |
| 5 | 18.3 | 18.2 | 20.9 | 4.47 | 443 | 0.84 |
| WATER COAGULANT CONTAINING 100 PPM POLYETHYLENE OXIDE | | | | | | |
| 6 | 20.1 | 3.4 | 21.4 | 6.4 | 296 | 4.8 |
| 7 | 20.8 | 6.8 | 25.2 | 7.2 | 297 | 2.4 |
| 8 | 21.3 | 8.8 | 25.7 | 7.2 | 288 | 2.0 |
| 9 | 21.5 | 13.3 | 24.9 | 5.9 | 342 | 1.1 |
| 10 | 20.3 | 18.4 | 21.5 | 5.1 | 387 | 0.90 |
| WATER COAGULANT BATH (CONTROL) | | | | | | |
| 11 | 21.7 | 3.4 | 22.1 | 6.9 | 276 | 4.1 |
| 12 | 22.8 | 7.1 | 24.9 | 6.6 | 336 | 2.3 |
| 13 | 22.6 | 9.1 | 24.8 | 6.5 | 326 | 1.9 |
| 14 | 21.8 | 14.0 | 14.6 | 3.7 | 388 | 1.0 |
| 15 | 19.5 | 13.5 | 21.8 | 5.1 | 399 | 1.3 |

The results indicated that fiber tenacity increased initially for all three coagulation baths as fiber orientation improved with increasing attenuation. However, as the SSF increased beyond a critical value, e.g., ~8 for this example, the fiber tensile properties started to deteriorate with further attenuation under the normal spinning practice using water as coagulant. If a bath containing PEO was used as the coagulant, the critical SSF could be extended to ~14 before the onset of tensile deterioration. Both PEO concentrations studied in this example, i.e., 10 and 100 ppm, worked equally well. The results also reflected the benefits of using a coagulation bath of this invention which permitted the reduction of filament denier beyond what can be achieved with a plain water coagulation bath making possible the production of subdenier (less than 1 denier per filament) products.

EXAMPLE 2

A 0.1% (by weight) solution of poly(acrylamide) (Polyscience, Catalog No. 02806, reported to be 5-6,000,000 molecular weight) was prepared in distilled water. The polymer was added to the water with rapid stirring to make a well dispersed suspension. The suspension was then placed on a roller mill and rolled until everything went into solution. A 0.1% (by weight) solution of poly (acrylamide) (Polyscience, Catalog No. 18522, reported to be 18,000,000 molecular weight) was prepared similarly.

A 19.4% solids spin dope of PPD-T was prepared and air gap spun in the manner similar to that described in Example 1. Two quench bath coagulants were prepared by diluting the two poly(acrylamide) polymer solutions, molecular weights 5-6,000,000 and 18,000,000, respectively, in water to 100 parts per million concentration. A plain water quench bath was used as a control.

The spinning experiment was carried out by collecting samples at increasing spin stretch factors using the three baths described above. Results are summarized in Table 2.

TABLE 2

| Sample # | JV | SSF | Tenacity (gpd) | Elongation (%) | Modulus (gpd) | dpf |
|---|---|---|---|---|---|---|
| WATER COAGULANT CONTAINING POLYACRYLAMIDE, 5-6,000,000 MW | | | | | | |
| 1 | 24.4 | 15.5 | 24.1 | 5.73 | 366 | 1.0 |
| 2 | 22.2 | 17.1 | 19.8 | 5.28 | 334 | 1.0 |
| 3 | 21.2 | 15.9 | 20.1 | 6.01 | 266 | 1.2 |
| 4 | 21.1 | 13.9 | 23.4 | 5.76 | 332 | 1.0 |
| 5 | 20.5 | 12.0 | 23.5 | 6.27 | 297 | 1.4 |
| 6 | 20.2 | 7.9 | 24.8 | 6.81 | 287 | 2.2 |
| 7 | 19.4 | 4.3 | 25.3 | 6.89 | 262 | 3.5 |
| WATER COAGULANT CONTAINING POLYACRYLAMIDE, 18,000,000 MW | | | | | | |
| 8 | 22.7 | 17.9 | 23.6 | 5.69 | 339 | 1.0 |
| 9 | 24.3 | 16.0 | 24.8 | 5.92 | 333 | 0.93 |
| 10 | 22.8 | 14.0 | 24.9 | 6.18 | 317 | 1.2 |
| 11 | 22.5 | 11.8 | 23.6 | 6.33 | 288 | 1.4 |
| 12 | 22.2 | 8.3 | 24.6 | 6.34 | 286 | 2.0 |
| 13 | 23.1 | 4.1 | 24.5 | 7.23 | 262 | 3.5 |
| WATER COAGULANT BATH (CONTROL) | | | | | | |
| 14 | 24.3 | 14.4 | 21.4 | 5.68 | 291 | 1.2 |
| 15 | 21.4 | 13.4 | 18.5 | 5.70 | 268 | 1.7 |
| 16 | 22.7 | 10.7 | 21.7 | 6.56 | 258 | 1.9 |
| 17 | 23.6 | 8.0 | 23.8 | 6.83 | 270 | 2.1 |
| 18 | 22.7 | 5.9 | 22.1 | 7.15 | 241 | 2.9 |

The results indicated that the coagulation baths containing poly(acrylamide) enabled achievement of greater SSF than did the control plain water bath. In addition, fibers derived therefrom exhibited higher tenacity than the controls over the entire range of SSF studied.

What is claimed is:

1. A process for the air gap spinning of an aramid fiber from an aramid solution wherein a solution of an aramid polymer is forced through an orifice, then travels through a layer of gas into a coagulant to form an aramid polymer fiber, wherein the improvement comprises, an aqueous coagulant which contains from 1 ppm to about 1,000 ppm by weight of an organic polymer which acts as a drag reducer, provided that said organic polymer is soluble in said coagulant and has a molecular weight of 200,000 or more.

2. The process as recited in claim 1 wherein said organic polymer is selected from the group consisting of poly(ethylene oxide), polyacrylamide, xanthans and guar gum.

3. The process as recited in claim 2 wherein said organic polymer is selected from the group consisting of poly(ethylene oxide) and polyacrylamide.

4. The process as recited in claim 1 wherein said molecular weight is 500,000 or more.

5. The process as recited in claim 4 wherein said molecular weight is 1,000,000 or more.

6. The process as recited in claim 3 wherein said organic polymer has a molecular weight of 1,000,000 or more.

7. The process as recited in claim 1 wherein said coagulant contains about 5 ppm to about 500 ppm of said organic polymer.

8. The process as recited in claim 1 wherein said coagulant contains about 8 ppm to about 200 ppm of said organic polymer.

9. The process as recited in claim 6 wherein said coagulant contains about 8 ppm to about 200 ppm of said organic polymer.

10. The process as recited in claim 1 wherein said aramid in the aramid solution is selected from the group consisting of poly(p-phenylene terephthalamide), poly(p-phenylene p,p'-biphenyldicarboxamide, poly(p-phenylene 1,5-naphthalenedicarobxamide) and poly(m-phenylene isophthalamide).

11. The process as recited in claim 9 wherein said aramid in the aramid solution is selected from the group consisting of poly(p-phenylene terephthalamide), poly(p-phenytene p,p'-biphenyldicarboxamide, poly(p-phenylene 1,5-naphthalenedicarobxamide) and poly(m-phenylene isophthalamide).

12. The process as recited in claim 1 wherein said aramid in the aramid solution is poly(p-phenylene terephthalamide).

13. The process as recited in claim 9 wherein said aramid in the aramid solution is poly(p-phenylene terephthalamide).

14. The process as recited in claim 9 wherein said aramid solution contains sulfuric acid as a solvent.

15. The process as recited in claim 1 wherein said aramid solution is lyotropic.

16. The process of claim 1 wherein said aramid solution contains sulfuric acid as the solvent.

* * * * *